United States Patent [19]

Miyoshi et al.

[11] Patent Number: 4,658,517

[45] Date of Patent: Apr. 21, 1987

[54] SKI BOOT

[75] Inventors: Terumasa Miyoshi; Shinichi Iwama, both of Saitama, Japan

[73] Assignee: Daiwa Seiko Inc., Tokyo, Japan

[21] Appl. No.: 821,483

[22] Filed: Jan. 22, 1986

[51] Int. Cl.[4] ..... A43B 5/04

[52] U.S. Cl. ..... 36/117; 36/121; 36/50

[58] Field of Search ..... 36/117–121, 36/50, 105; 24/68 SK, 69 SK, 70 SK, 71 SK

[56] References Cited

U.S. PATENT DOCUMENTS

| | | | |
|---|---|---|---|
| 3,803,730 | 4/1974 | Hanson et al. | 36/117 |
| 3,968,578 | 7/1976 | Rathmell | 36/121 |
| 4,043,059 | 8/1977 | Rathmell | 36/121 |
| 4,095,356 | 6/1978 | Robran et al. | 36/121 |
| 4,447,970 | 5/1984 | Delery | 36/121 |
| 4,575,957 | 3/1986 | Petrini | 36/121 |

FOREIGN PATENT DOCUMENTS

| | | | |
|---|---|---|---|
| 1963342 | 6/1971 | Fed. Rep. of Germany | 36/120 |
| 3045928 | 9/1981 | Fed. Rep. of Germany | 36/117 |
| 2555418 | 5/1985 | France | 36/117 |

*Primary Examiner*—James Kee Chi

*Attorney, Agent, or Firm*—Kalish & Gilster

[57] ABSTRACT

A ski boot which comprises a shell body having a sole and a lower shell, a pair of upper shell members engaged to said shell body on opposite sides thereof, and being in confronting relationship, said upper shell members being spaced apart at their front and rearward ends to define front and rear openings, front and rear cuffs presented between said upper shell members for disposition with respect to said front and rear openings respectively. Each of said front and rear cuffs are swingably engaged in the lower end portions thereof to the shell body for swingable movement longitudinally of the boot for providing an expanded opening for facilitating foot insertion into, and removal from, the boot. An inner boot contains a lower portion received within the shell and having separable upper portions engaged to the related cuffs for movement therewith.

5 Claims, 7 Drawing Figures

SKI BOOT

FIELD OF THE INVENTION

The present invention relates to ski boots, and more particularly to ski boots which are capable of expansibility to permit skiers to put on the boots with ease, as well as to withdraw their feet therefrom in like manner. After the boots have been put on, the same are readily adapted for contraction to provide a snug positive fit.

BACKGROUND OF THE INVENTION

Recent ski boots comprise each a shell formed of a hard plastic material, and an inner boot for holding a skier's foot within the shell in close contact condition without any gaps. In order to favorably hold the foot in the ski boot for the improved operability of a ski plate while skiing, a fastening mechanism is used to fasten an upper portion of the shell embracing the lower leg end, or fixedly hold the instep, thereby ensuring skiers to enjoy a comfortable fit at lower ends of their legs.

Heretofore, ski boots of this type are disclosed in Japanese Patent Publication No. 55-7242 (1980) by way of example.

The disclosed ski boot has a shell body which is formed in its rear portion with a cut-out opening extending from an upper end to an ankle part of the shell body. The cut-out opening is capable of spreading, with compatible deformation of the shell body; and a tongue member is disposed in association with the cut-out opening for closing the same from the inside. The tongue member is connected at its lower end to an inner bottom of the shell body through a flexible part, so that when the foot is placed into, and withdrawn from, the boot, the tongue member is tiltable about the flexible part toward the outside of the shell body through the cut-out opening.

With such a ski boot including the shell body provided with the cut-out opening, the skier's foot can be inserted within, and withdrawn from, the boot by spreading the cut-out opening and then tilting the tongue member outwardly.

However, because the shell body is formed of a semi-hard or hard plastic material for the purpose of stably and favorably holding the skier's foot in the boot, a substantial force by the fingers is required to expand and deform the cut-out opening so that feet encased in thick socks may be inserted within, and withdrawn from, the boot with relative ease. If the cut-out opening is not expanded and deformed to the requisite extent, a skier, upon donning the boot, as well as removing the foot therefrom, will necessarily experience pain or discomfort in the instep, ankle, and adjacent zones subjected to the insufficiently expanded opening with the concurrent pressure caused thereby. It is also conceivable to increase the mouth diameter of the shell body for facilitating foot insertion and withdrawal. But this arrangement causes an inadequacy in both the manner in which the lower leg end of the shell body fits, as well as the fastening of such lower leg end, thereby resulting in further problems imparing the edge operation of a ski plate.

SUMMARY OF THE INVENTION

The present invention has been accomplished with a view of solving the above-mentioned problems in the prior art, and has for its object to provide ski boots which permit skiers to easily insert their feet into, and withdraw their feet from, the boots without the necessity of expanding the cross section of the opening or mouth of a shell body.

Since a boot mouth or opening is defined by four members, i.e., a pair of left and right upper shells, and front and rear cuffs, to be capable of spreading adequately, the present invention has the following advantageous objects.

A first advantageous object is that the skier's foot can be easily inserted into, and withdrawn from, the ski boot without effort, whereby the instep and ankle will not be subjected to uncomfortable pressure, thereby preventing the skier from sensing any pain.

A second advantageous object is in that fastening forces are exerted in all the four directions, i.e., from the front, rear, left and right, to provide an excellent fit with the skier's foot and lower leg end.

A third advantageous object is in that the shell body is formed of a relatively soft material and the pair of left and right upper shells are formed of a relatively hard material so that any desired combinations thereof provide for compatibility with the requirements of obtaining conditions and, wherefore, the ski boot is pliable in the longitudinal direction and the pair of hard left and right upper shells provide a rapid response in the edge operation.

A fourth advantageous object is in that forces exerted in the longitudinal direction while walking are moderately alleviated to conduce to greater ease in walking.

DETAILED DESCRIPTION OF PREFERRED EMBODIMENT OF THE INVENTION

Figure 1:
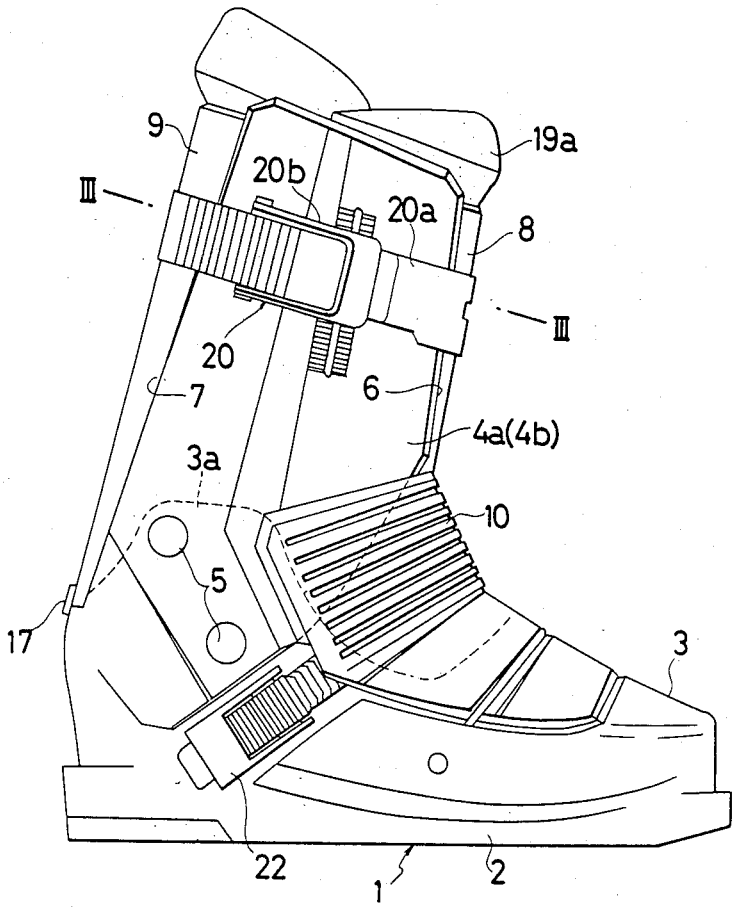
FIG. 1 is a side view of a ski boot construction in accordance with and embodying the present invention.
Figure 3:
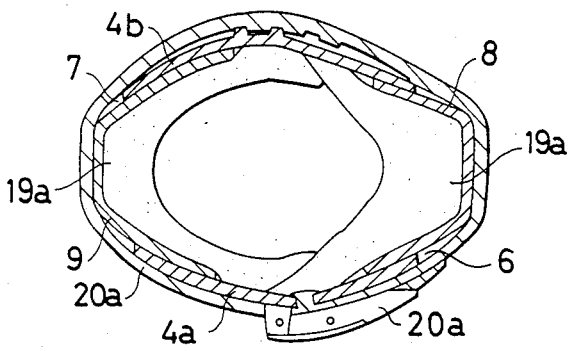
FIG. 3 is a horizontal sectional view taken along the line III—III in FIG. 1.
Figure 2:
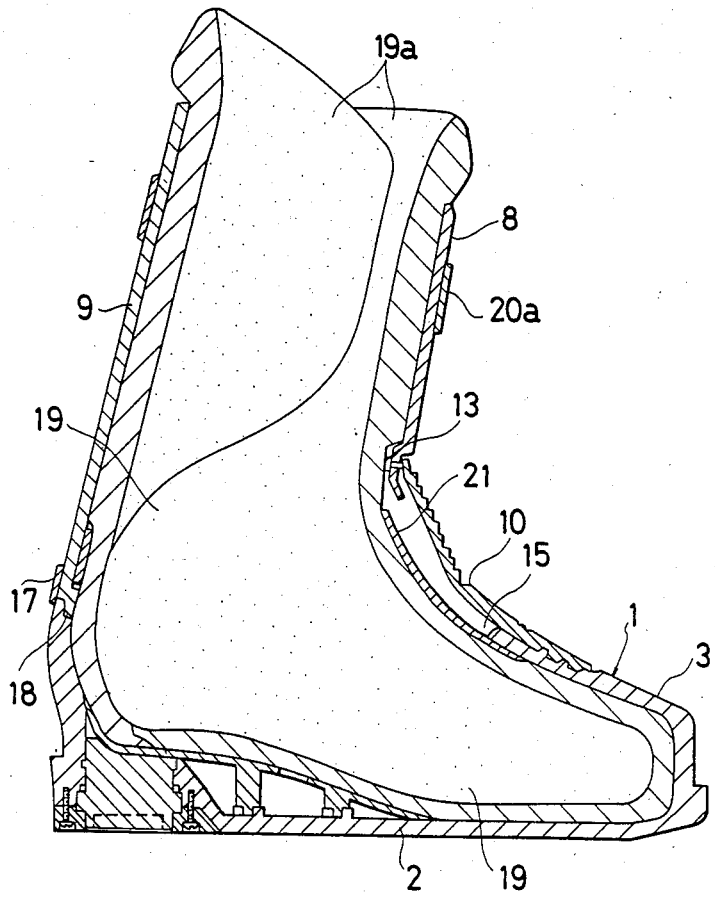
FIG. 2 is a vertical longitudinal sectional view of the ski boot illustrated in FIG. 1.

Hereinafter, the preferred embodiment of the present invention will be described with reference to FIGS. 1 through 6, inclusive.

Designated at 1 is a shell body formed of a hard plastic material, such as polyurethane, and comprises a sole 2, a lower shell 3 for covering a skier's foot, including the instep, ankle, and adjacent zones; and a pair of upper, right and left shells 4*a*, 4*b* for covering the adjacent lower portion of the skier's leg. Upper shells 4*a*, 4*b* are each integrally secured at the lower ends thereof to a corresponding upper end 3*a* of the shell 3 by a plurality of rivets 5, whereby said upper shells 4*a*, 4*b* are capable of being laterally expanded or spread outwardly away from each other with relative ease.

Between upper shells 4*a*, 4*b*, at their respective front and rear ends, there are provided openings 6, 7 which extend vertically; said openings 6, 7 being adapted for closure from the inside by front and rear cuffs 8, 9 respectively, which are constituted of hard plastic and shaped into the form of a substantially channel complementary to openings 6, 7, respectively. The lower ends of front and rear cuffs 8, 9 are respectively connected to the upper ends of a cover member 10, to be described more fully hereinbelow, and the lower shell 3 for pivotability in the longitudinal direction, i.e., forwardly and rearwardly.

Figure 4:
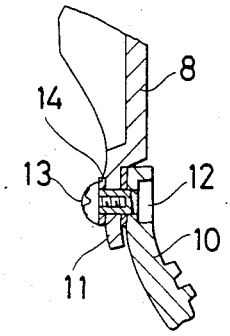
FIG. 4 is a fragmentary enlarged vertical sectional view showing one example of a front cuff supporting mechanism for use in the ski boot of the present invention.

A means for pivotably supporting front cuff 8 in the longitudinal direction is accomplished as follows: As shown in FIG. 4, formed integrally with front cuff 8, at the lower end thereof, is a flexible connecting element 11; there being a connecting pin 12 which is supported by, and penetrates through, an upper edge of cover member 10. Pin 12 comprises a shaft which projects inwardly for extension through an opening in connecting element 11; a screw 13 threadedly engages the internal threads of the extended inner end of the shaft of pin 12 and is snugly fastened against the connecting element 11 by means of a washer 14, to thereby couple connecting member 11 and cover member 10. With this arrangement, front cuff 8 is rendered capable of pivoting relative to the shell body 1 in the longitudinal direction about the pivot axis established by element 11. Cover member 10 serves to cover an opening 15 extending from the lower end of the skier's leg to the instep, and with the lower end of said opening 15 being defined by lower shell 3.

Figure 5A:
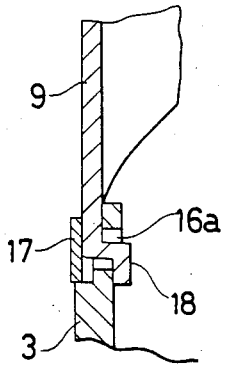
FIG. 5A is a fragmentary enlarged vertical sectional view showing one form of a rear cuff supporting mechanism for use in the ski boot of the present invention.
Figure 5B:
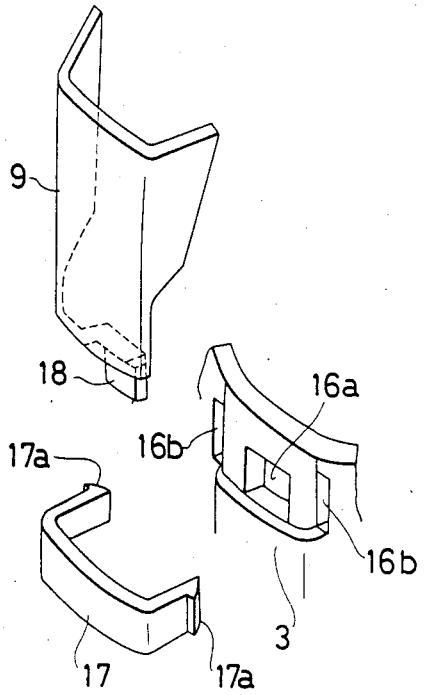
FIG. 5B is a fragmentary exploded perspective view of the rear cuff supporting mechanism.

One manner for pivotably supporting rear cuff 9 for swinging in the longitudinal direction may be effected as follows. With reference to FIGS. 5A and 5B, a supporting hole 16*a* is provided, as by boring, in the central portion of the upper edge of lower shell 3, in the rear of the ankle portion thereof. A U-shaped connecting metal fixture 17 is provided in the opposite ends of the legs thereof with locking pawls 17*a*. Fixture 17 is engageable with openings 16*b* formed on either side of supporting hole 16*a* of lower shell 3. Said locking pawl 17*a* serves to prevent fixture 17 from becoming accidentally removed or displaced. A flexible connecting extension 18 integrally projects from the lower end of rear cuff 9 for engagement within the supporting hole 16*a* and being maintained securely in such position by connecting metal fixture 17, whereby rear cuff 9 is pivotable relative to lower shell 3 in the longitudinal direction about the pivot established by connecting extension 18.

Designated at 19 (FIGS. 2, 3, 6) is an inner boot which is formed of a soft material and comprises a liner for shell body 1 and, thus, in use will be interposed between shell body 1 and the skier's foot; said inner boot 19 effecting a close, comfortable fit for the skier's foot within shell body 1. Inner boot 19 includes an upper portion 19*a* which is adapted for separability forwardly and rearwardly as may best be seen in FIG. 6. Designated at 20 (see FIG. 1) is a fastening device adapted to fasten the outer circumferences of upper shells 4*a*, 4*b* and front and rear cuffs 8 and 9. Said fastening device 20 is composed of a belt 20*a* and a buckle 20*b* (see FIGS. 1 and 3). Said fastening device 20 serves for adjusting both the forwardly tilting angle and the forwardly tilting pressure for the skier.

Designated at 21 (see FIGS. 2 and 6) is a sheet-like retainer member located inside cover member 10 and superimposed upon the outer surface of inner boot 19. Retainer member 21 serves to maintain the boundary portion between the instep of the skier's lower foot and leg end continuously joining thereto, from above the inner boot 19. One end of retainer member 21 is connected to a fastening device 22 (see FIGS. 1*a* and 6) which is suitably attached to the outer surface of lower shell 3.

Figure 6:
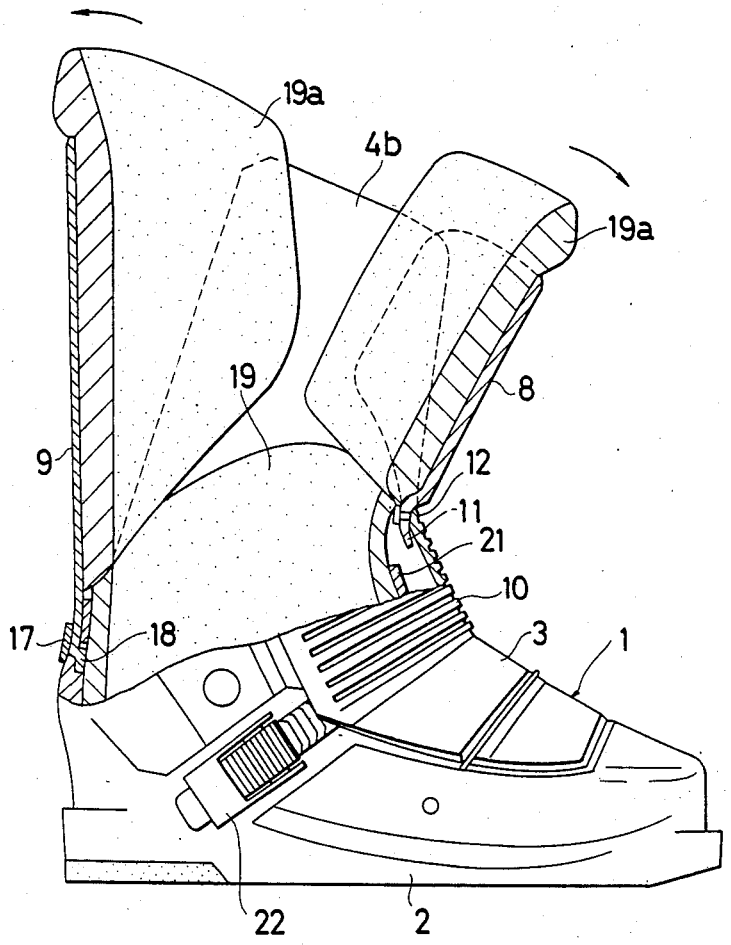
FIG. 6 is a vertical view partially in section illustrating the front and rear cuff of the ski boot of the present invention in expanded or spread state.

When skiers put on, and take off, the ski boots of the present invention, fastening device 20 is released and, thereafter, front cuff 8 and rear cuff 9 are tilted outwardly, by hand, about the respective pivot points established by connecting element and extension 11, 18 respectively, as shown in FIG. 6. At this juncture, front cuff 8 and rear cuff 9 are pivoted to wedge into the lower portions of the openings 6, 7, respectively thereby widening or spreading same, causing left and right upper shells 4*a*, 4*b* respectively to be expanded and deformed outwardly simultaneously. After that, the separable foot end portions 19*a* of inner boot 19 are opened forwardly and rearwardly, away from each other, and the skier may then insert his foot into inner boot 19 through the now enlarged boot mouth or withdraw his foot from the boot with equal facility.

The upper portion of shell body 1, covering the lower end of a skier's leg, is constituted of the pair of left and right upper shells 4*a*, 4*b* which are capable of being outwardly spread, expanded or deformed and of the pair of front and rear cuffs 8 and 9 which are adapted to effect closure of vertical openings 6, 7 formed between said upper shells 4*a*, 4*b* in the front and rear of the boot body 1; said cuffs 8, 9 being capable of pivoting in the longitudinal direction. Whereby the main opening or mouth of boot body 1 is adequately spread, with the result that the skier's foot, even if covered by thick socks, can be easily inserted into, and withdrawn from, the boot of the present invention without exertion of effort. It is to be seen that the cross section or diameter of the main opening or mouth of the boot can be adjusted to such extent as is adequate for accommodating the thickness of the skier's leg end irrespective of the size of the skier's foot. Therefore, with the present invention there is no necessity of taking into account the size of the skier's foot for appropriately setting the cross section or diameter of the boot mouth, unlike the prior art.

Incidentally, it is understood that the means for pivotably supporting the front cuff 8 and the rear cuff 9 in the present invention are not limited to those disclosed in the above embodiment.

As described above, according to the present invention, since the portion of the shell body covering the skier's lower leg end, is composed of a pair of left and right upper shells capable of outwardly spreading and deforming, as well as front and rear cuffs adapted to close the openings formed between the left and right upper shells in the front and rear of the boot, respectively, being adapted for pivoting in the longitudinal direction, thereby allowing the boot mouth to be spread to the extent requisite, it permits skiers to easily insert their feet into the ski boots without effort, and to effect withdrawal of the same in the same effortless fashion.

What is claimed is:

1. A ski boot comprising a shell body having a sole and a lower shell, a pair of upper shell members, means connecting said upper shell members to said lower shell on opposed sides thereof, means for engaging said upper shell members to the proximate upper end portion of said lower shell for disposition adjacent the proximate lateral portions of the skier's lower leg, said upper shell members being spaced apart in their forward and rearward portions to define vertically extending front and rear openings, said engaging means adapting said upper and lower shell members for laterally outward spreading movement away from each other and for returning movement toward each other, a front cuff and a rear cuff for effecting closure of said front and rear openings respectively, said front and rear cuffs being adapted for pivotal movement longitudinally of the boot, a resilient pivot members integrally formed centrally at the lower end of said rear cuff, a supporting opening formed in the rearward upper portion of said lower shell receiving said pivot member, and locking means for inhibiting disengagement of said pivot members within said supporting opening whereby said rear cuff may swing rearwardly and forwardly, said pivot member comprising a flexible extension projecting forwardly through said supporting opening for engaging a portion of said lower shell internally of said supporting opening, and further comprising an inner boot comprising a lower portion fixed within said lower shell and upper separable portions engaged respectively with said front and rear cuffs.

2. A ski boot as defined in claim 1 wherein a flexible connecting element is provided centrally in the lower end portion of the front cuff, said flexible connecting element being provided with an opening axially perpendicular to said element, and pin-forming means tightly engaging said flexible connecting element to the lower shell whereby said front cuff is swingable in a direction longitudinally of the boot and hence of the pin-forming means.

3. A ski boot as defined in claim 2 wherein the upper separable portions of said inner boot are adapted for simultaneous movement with the related front and rear cuffs.

4. A ski boot as defined in claim 2, said pin-forming means comprising a shaft extending through said axially perpendicular opening, said shaft being internally threaded, and a screw threaded into said shaft for securing said flexible connecting element to said lower shell.

5. A ski boot as defined in claim 2 wherein said locking means comprises a U-shaped fixture including locking pawls at opposite sides thereof, open apertures formed in the rearward upper portion of said lower shell on opposite sides of the supporting opening therein, said apertures receiving the locking pawls for maintaining the U-shaped fixture in locking position for inhibiting disengagement of said pivot means.

* * * * *